US010877412B2

(12) United States Patent
Yashiro et al.

(10) Patent No.: US 10,877,412 B2
(45) Date of Patent: Dec. 29, 2020

(54) FIXING DEVICE

(71) Applicant: CANON KABUSHIKI KAISHA, Tokyo (JP)

(72) Inventors: Ryo Yashiro, Tokyo (JP); Shuichi Tamura, Moriya (JP); Hiroshi Miyamoto, Kawaguchi (JP); Naoyuki Yamamoto, Nagareyama (JP); Shinsuke Takahashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/739,703

(22) Filed: Jan. 10, 2020

(65) Prior Publication Data

US 2020/0150569 A1 May 14, 2020

Related U.S. Application Data

(63) Continuation of application No. PCT/JP2018/026628, filed on Jul. 10, 2018.

(30) Foreign Application Priority Data

Jul. 11, 2017 (JP) ..... 2017-135314

(51) Int. Cl.
*G03G 15/20* (2006.01)

(52) U.S. Cl.
CPC ..... *G03G 15/2057* (2013.01); *G03G 15/2007* (2013.01); *G03G 15/2039* (2013.01); *G03G 2215/2016* (2013.01)

(58) Field of Classification Search
CPC ..... G03G 15/2057; G03G 15/2007; G03G 15/2039; G03G 2215/2016; G03G 2215/2035; G03G 15/2053; G03G 15/206
See application file for complete search history.

(56) References Cited

U.S. PATENT DOCUMENTS 8,909,118 B2 12/2014 Seol et al.
2014/0161500 A1 6/2014 Kataoka et al.
(Continued)

FOREIGN PATENT DOCUMENTS

JP 2010-032973 A 2/2010
JP 2014-115514 A 6/2014
(Continued)

OTHER PUBLICATIONS

International Search Report issued in International Application No. PCT/JP2018/026628 dated Oct. 2, 2018.

*Primary Examiner* — Sandra Brase
(74) *Attorney, Agent, or Firm* — Venable LLP

(57) ABSTRACT

A fixing device including an endless belt, a heat source, a rotatable member forming a nip together with a belt, a nip forming member, a contact member contacting an inner peripheral surface of the belt, a reflecting portion reflecting radiation heat from the heat source toward the nip forming member, a heat conducting portion, and a heat insulating member. The nip forming member includes a first member having a U-shape made of metal and open on a side opposite from the rotatable member and a second member provided inside the first member. The heat conducting portion conducts heat of the reflecting portion to the contact member. The heat insulating member is provided between the first member and the second member. A thickness t (μm) and thermal conductivity λ (W/m·K) of the heat insulating member satisfy:

$t \geq 100$ (μm)

$0.02$ (W/m·K) $\leq \lambda \leq 0.05$ (W/m·K).

14 Claims, 4 Drawing Sheets

(56) References Cited

U.S. PATENT DOCUMENTS

| | | | | |
|---|---|---|---|---|
| 2015/0261155 | A1* | 9/2015 | Yoshiura | G03G 15/2053 399/329 |
| 2015/0346657 | A1 | 12/2015 | Kondo | |
| 2016/0011548 | A1 | 1/2016 | Utsunomiya et al. | |
| 2016/0091852 | A1* | 3/2016 | Matsuno | G03G 15/2053 399/322 |
| 2016/0274519 | A1 | 9/2016 | Lim et al. | |

FOREIGN PATENT DOCUMENTS

| | | | |
|---|---|---|---|
| JP | 2015-225163 | A | 12/2015 |
| JP | 2016-018161 | A | 2/2016 |
| JP | 2016-102894 | A | 6/2016 |

* cited by examiner

FIXING DEVICE

CROSS-REFERENCE TO RELATED APPLICATIONS

This application is a continuation of International Patent Application No. PCT/JP2018/026628 filed Jul. 10, 2018, which claims the benefit of Japanese Patent Application No. 2017-135314 filed Jul. 11, 2017. These applications are incorporated by reference herein in their entireties.

TECHNICAL FIELD

The present invention relates to a fixing device capable of being mountable in an image forming apparatus such as a multi-function machine, a copying machine, a printer, or a facsimile machine.

BACKGROUND ART

In order to shorten a warm-up time, a fixing device of a type in which a fixing film (endless belt) is heated has been widely used because of the thermal capacity reduction of the fixing member provided by the fixing film. However, in a fixing device using a halogen heater for a heat source, as described in Japanese Laid-Open Patent Application 2010-032973, heating efficiency of the fixing film lowers due to heat inflow to members, other than the endless belt. In U.S. Pat. No. 8,909,118, a technique in which a metal reflecting plate is provided between a halogen heater and a pressing member has been proposed, and thus heat flow to the pressing member is suppressed.

SUMMARY OF THE INVENTION

Problem to be Solved by the Invention

However, a temperature of the metal reflecting plate in U.S. Pat. No. 8,909,118 gradually increases during continuous sheet passing, so that heat, thereof flows into the pressing member. For that reason, a percentage of the electrical power necessary to heat the fixing film is used for a member other than the fixing film, such as the pressing member.

An object of the present invention is to provide a fixing device capable of reducing electrical power consumption during continuous sheet passing by suppressing heat inflow to the pressing member provided inside the endless belt when the endless belt rotatable at an outer periphery of the heat source is heated by the heat source.

Means for Solving the Problem

In order to accomplish the above-described object and according to one aspect, the present invention provides a fixing device. The fixing device includes a rotatable endless belt, a heat source, a rotatable member, a nip forming member, a contact member, a reflecting portion, a heat conducting portion, and a heat insulating member. The heat source is configured to heat the endless belt and is provided inside the endless belt. The rotatable member is provided outside the endless belt and forms a nip in which a toner image on a recording material is fixed together with the endless belt. The nip forming member is made of metal, provided inside the endless belt, and forms the nip in cooperation with the rotatable member. The nip forming member includes a first member having a U-shape that is open on a side opposite from the rotatable member through the nip in a cross-section perpendicular to a longitudinal direction of the rotatable member. The nip forming member also includes a second member provided inside the first member. The contact member is provided between the nip and the nip forming member and contacts an inner peripheral surface of the endless belt. The reflecting portion is configured to reflect, toward the inner peripheral surface of the endless belt, radiation heat from the heat source toward the nip forming member. The heat conducting portion contacts the contact member and is configured to conduct heat of the reflecting portion to the contact member. The heat insulating member is provided between the first member and the second member. A thickness t (μm) and thermal conductivity λ (W/m·K) of the heat insulating member satisfy the following relationships:

$$t \geq 100\ (\mu m);\ \text{and}$$

$$0.02\ (W/m \cdot K) \leq \lambda \leq 0.05\ (W/m \cdot K).$$

EMBODIMENTS FOR CARRYING OUT THE INVENTION

In the following, embodiments of the present invention will be described on the basis of the attached drawings.

First Embodiment (Image Forming Apparatus)

Figure 1:
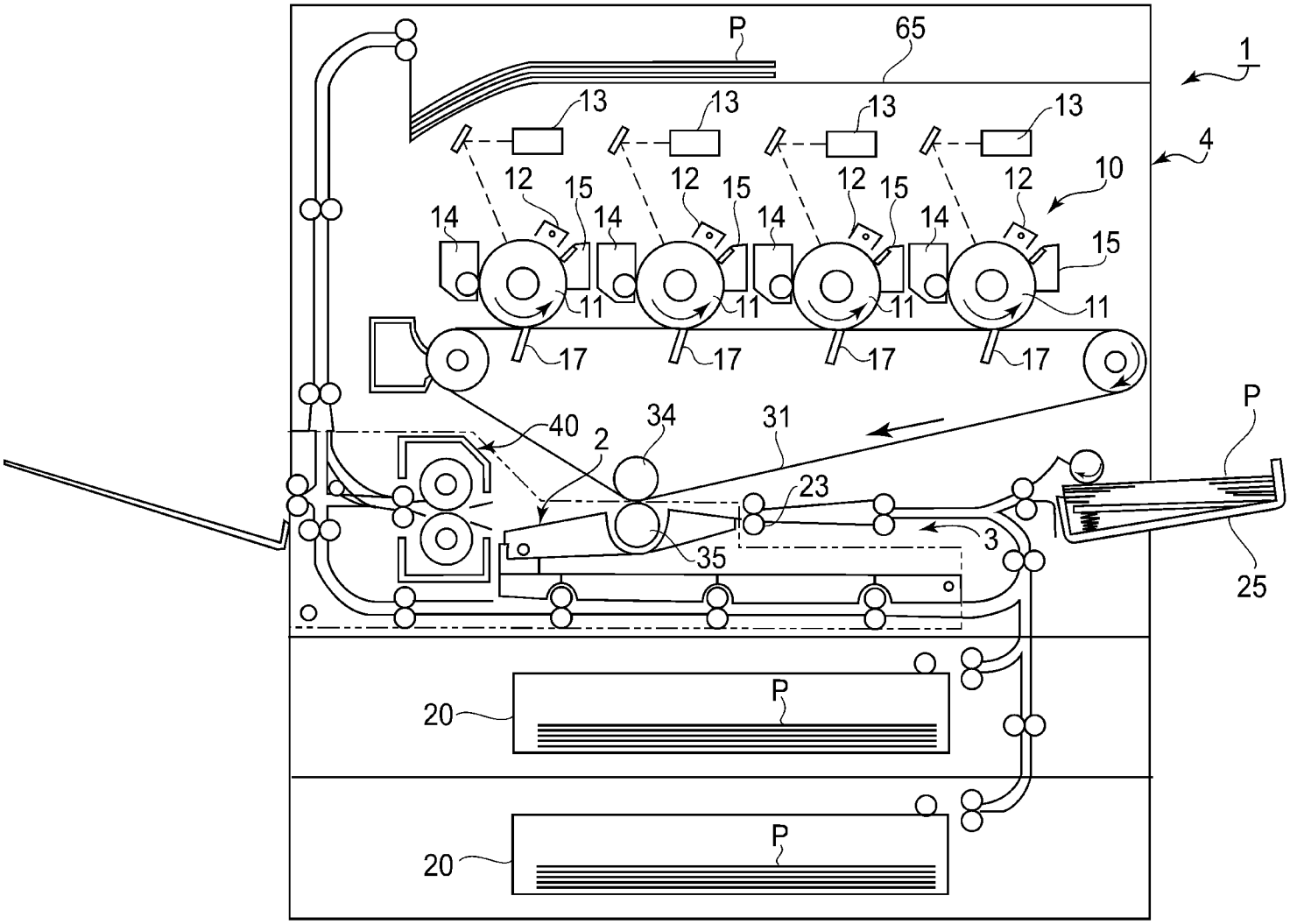
FIG. 1 is a schematic view of an image forming apparatus in which a fixing device according to this embodiment is mounted.

FIG. 1 is a sectional view of a color electrophotographic printer 1, which is an example of an image forming apparatus of this embodiment, and is the sectional view along a sheet feeding direction. In this embodiment, the color electrophotographic printer will be simply referred to as a "printer".

The printer 1 shown in FIG. 1 includes image forming portions 10 for respective colors of Y (yellow), M (magenta), C (cyan) and Bk (black) in an image forming apparatus main assembly 4. A photosensitive drum 11 is electrically charged in advance by a charger 12. Thereafter, on the photosensitive drum 11, a latent image is formed by a laser scanner 13. Then, the latent image is changed to a toner image by a developing device 14. Toner images on the photosensitive drums 11 are successively transferred onto, for example, an intermediary transfer belt 31 which is an image bearing member by primary transfer blades 17. After transfer, the toner remaining on each photosensitive drum 11 is removed by a cleaner 15. As a result of this, a surface of the photosensitive drum 11 becomes clean, and prepares for subsequent image formation.

On the other hand, a sheet P as a recording material (recording paper) is sent one by one from a sheet (paper)

cassette 20 or a multi-sheet (paper) feeding tray 25 and is sent to a registration roller pair 23. The registration roller pair 23 receives the sheet P and rectifies the sheet P to be straight in the case when the sheet P has obliquely moved. Then, the registration roller pair 23 synchronizes the sheet P with the toner images on the intermediary transfer belt 31 and sends the sheet to a nip between the intermediary transfer belt 31 and a secondary transfer roller 35. A color toner image on the intermediary transfer belt is transferred onto the sheet P by, for example, the secondary transfer roller 35 which is a transfer(-receiving) member. Thereafter, the toner image on the sheet is fixed on the sheet by heating and pressing the sheet by a fixing device 40.

(Fixing Device)

Next, the fixing device 40 according to the embodiment of the present invention will be described using FIG. 2. In the fixing device according to the present invention, a longitudinal direction is a direction perpendicular to a feeding direction of the recording material and perpendicular to a thickness direction of the recording material. Further, a short side direction is the feeding direction of the recording material. The fixing device 40 of this embodiment uses a tensionless endless belt (hereafter referred to as a belt) 41. As will be described further below, the belt 41 is a fixing film that is heated.

A halogen heater (hereafter referred to as a heater) 43 is used as a heat source (heating member, heat generating member), and is fixed to a side plate of the fixing device 40 at both end portions thereof with respect to the longitudinal direction. The heater output is controlled by a power source portion of the image forming apparatus main assembly 4. Radiant heat (radiation heat) of the heater 43 is reflected by a reflecting plate 42, which is a reflecting member, provided in the belt 41 as seen from the longitudinal direction. The radiant heat thus reaches the belt 41 so that the belt 41 is heated.

The belt 41 is a cylindrical (endless) heat-resistant fixing film is externally fitted, loosely, so as to contain the heater 43. The belt 41 in this embodiment is the fixing film including a four-layer composite structure of a surface layer, an elastic layer, base layer and an inner surface coating layer. The surface layer (parting layer) may use a fluorine-containing resin material having a thickness of 100 μm or less, preferably from 20 μm to 70 μm. As the fluorine-containing resin layer, for example, it is possible to use PTFE, FEP, PFA, and the like. In this embodiment, a 30 μm-thick PFA tube was used.

The elastic layer may use a rubber material having a thickness of 1000 μm or less, preferably 500 μm or less, in order to improve a quick start property by making thermal capacity small. For example, it is possible to use a silicone rubber, a fluorine-containing rubber, and the like. In this embodiment, a silicone rubber, having a rubber hardness (JIS-A) of 10 degrees, thermal conductivity of 1.3 W/m·K, and a thickness of 300 μm, was used.

The base layer may use a heat-resistant material having a thickness of 100 μm or less, preferably 50 μm or less and 20 μm or more, in order to improve the quick start property similar to the elastic layer. For example, a metal film of SUS, nickel, or the like can be used. In this embodiment, a cylindrical nickel metal film of 30 μm in thickness and 25 mm in diameter was used.

The inner surface coating layer may be formed from a resin layer having a heat-resistant property, ceramics, metal, and the like since the inner surface coating layer contacts a pressing roller 44. For example, polyimide, polyimideamide, PEEK, polytetrafluoroethylene resin (PTFE), and tetrafluoroethylene/hexafluoropropylene copolymer resin (FEP) may be used. Further, engineering plastics such as tetrafluoroethylene/perfluoroalkyl vinyl ether copolymer resin (PFA), diamond-like carbon (DLC), and the like may be used. An inner surface of the inner surface coating layer may be painted black or otherwise subjected to coating for promoting heat absorption.

The heat-resistant elastic pressing roller 44, as an opposing member opposing the belt 41, may comprise a core metal made of a metal material (for example, aluminum or SUS) and an elastic layer. The elastic layer may comprise comprising a heat-resistant rubber such as silicone rubber or a fluorine-containing rubber, or a foam material of the silicone rubber. Further, both end portions of the core metal, with respect to the longitudinal direction, are rotatably shaft-supported. The belt 41 and the heater 43 are disposed on an upper side of the pressing roller 44 (on a side opposing the pressing roller 44).

Figure 2:
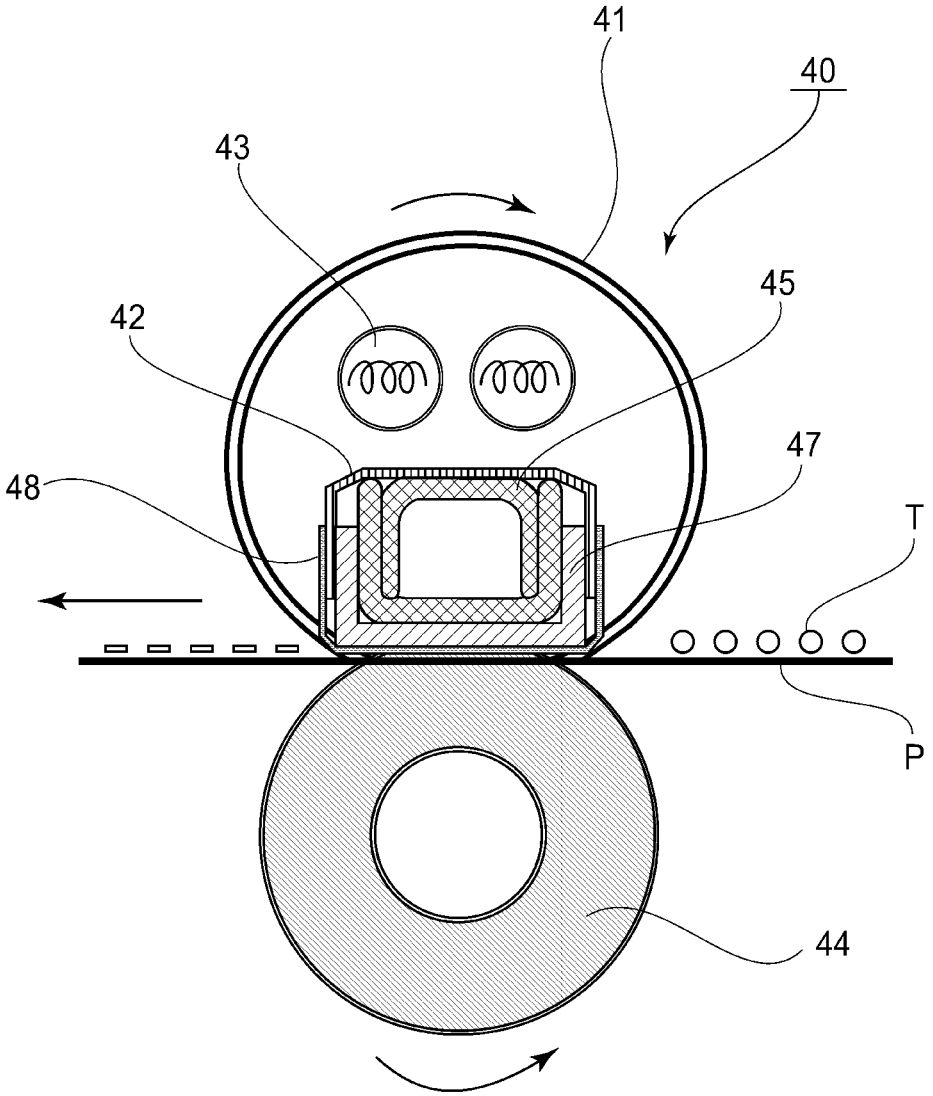
FIG. 2 is a schematic view of the fixing device according to this embodiment of the present invention.
Figure 3:
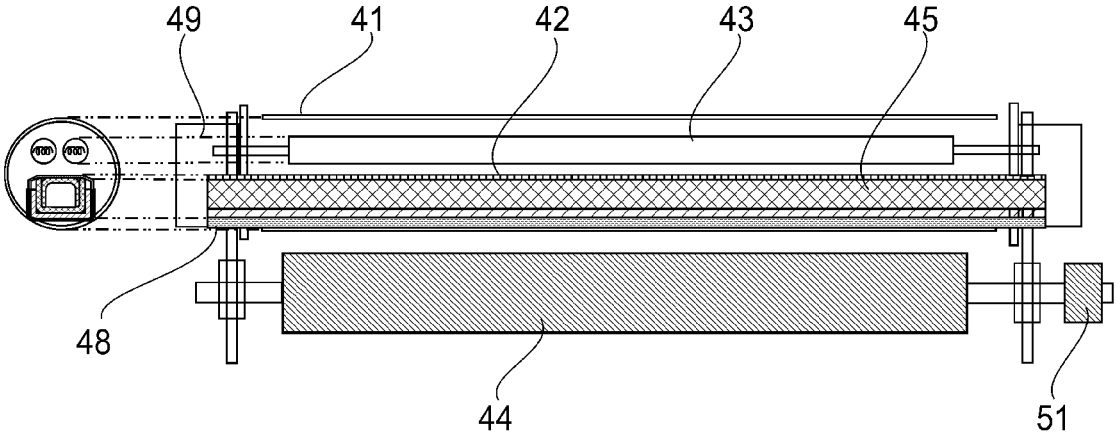
FIG. 3 is a longitudinal plan view of the fixing device according to this embodiment of the present invention.

The pressing roller 44 is rotatably supported at both ends by bearings fixed to a frame of the fixing device 40, and is rotationally driven counterclockwise at a predetermined rotational peripheral speed in FIG. 2 by a motor 51 (FIG. 3). A rotational force acts on the belt 41 by a press-contact force in a nip N formed by the pressing roller 44 and the belt 41 due to the rotational drive of the pressing roller 44. Then, the belt 41 is in a state in which the belt 41 is rotated clockwise in FIG. 2 by the pressing roller 44.

A slidable member 48 is provided inside the belt 41, and in a region where the nip N of the belt 41 is formed, the slidable member 48 contacts in inner peripheral surface of the belt 41 as a contact member. That is, the belt 41 rotates while sliding on a downward surface (outer surface) of the slidable member 48 at the inner peripheral surface thereof. The slidable member 48 is also a rotation guide member of the belt 41. In this embodiment, the slidable member 48 is also a rotation guide member of the belt 41. In this embodiment, the slidable member 48 is bent in a U-shape and a side surface thereof also has a function as a heat conducting portion described later.

A pressing member (pressing stay, rigid member) 45 is a nip forming member made of metal for forming the above-described nip in cooperation with the pressing roller 44. The pressing member 45 is provided on a side opposite from the nip with respect to the slidable member 48 and presses the belt 41 through the slidable member 48 in a direction of the pressing roller 44. The pressing member 45 includes, as described later, a first pressing member **45*b* having a U-shape which is open on a side opposite from the pressing roller via the nip in a cross-sectional shape perpendicular to the longitudinal direction of the pressing roller and includes a second pressing member 45*a* provided inside the first member 45*b***.

Here, when urging (pressing) is carried out by an unshown urging spring (for example, 160N at each of both ends), the pressing member 45 imparts the urging (pressing) force to an entirety of a flange 49 at both end portions with respect to the longitudinal direction shown in FIG. 3. By this, an outer peripheral surface of the belt 41 and an upper surface of the pressing roller 44 are press-contacted to each other against elasticity of the elastic layer of the pressing roller 44, so that a fixing nip (nip) N, with a predetermined width, is formed as a heating portion.

The pressing roller is rotationally driven, and with that, the belt 41 is rotated. The recording material P, carrying thereon the unfixed toner image T, is introduced into the nip N in a state in which the heater 43 is energized and the belt 41 has increased in temperature to a predetermined temperature as the belt 41 is rotated. Then, a surface of the recording material P carrying the unfixed toner image T intimately contacts the outer peripheral surface of the belt 41 in the nip N and is nipped and fed together with the belt 41 through the nip N.

In this nip-feeding process, the recording material P is heated by heat of the belt 41, which, as discussed above, has been heated by the heater 43, so that the unfixed toner image T on the recording material is heated and pressed on the recording material P and is melt-fixed. The recording material P passed through the nip N is curvature-separated from the outer peripheral surface of the belt 41 and is discharged and fed.

In FIG. 3, the pressing member 45 is fixed and supported by unshown side plates at both end portions thereof with respect to the short side direction. Further, the reflecting plate 42 is fixedly supported by the flange 49 and is provided above the pressing member 45. A length of the fixing film 41 with respect to the longitudinal direction is 340 mm, and the reflecting plate 42 and the pressing roller 44 are 330 mm in length with respect to the longitudinal direction. Further, the slidable member 48 and the pressing member 45 are 360 mm in length with respect to the longitudinal direction.

(Pressing Unit)

Figure 4:
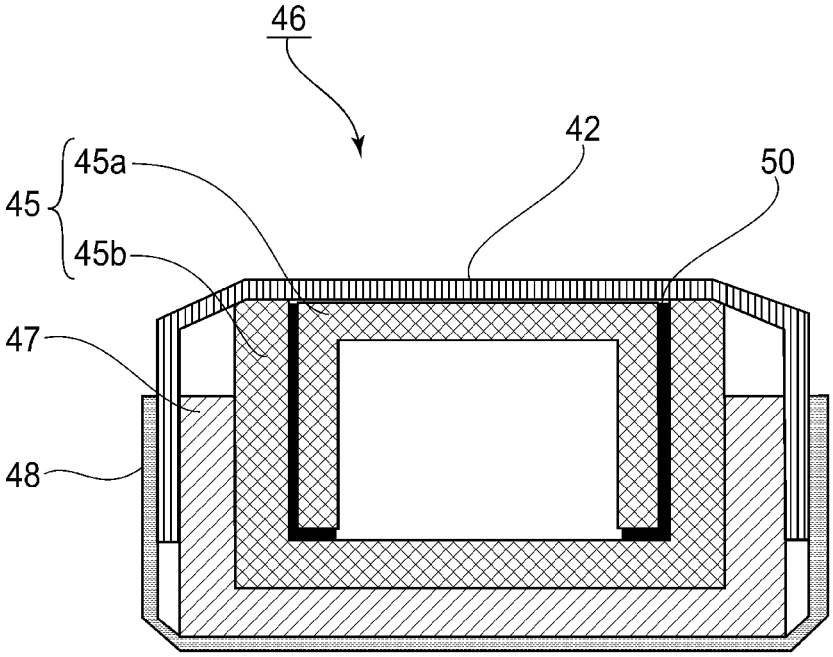
FIG. 4 is an enlarged view of a pressing member according to this embodiment of the present invention.

In this embodiment, as shown in FIG. 4, the pressing member 45 is assembled as a pressing unit 46 by incorporating other members. That is, the pressing unit 46 includes the pressing member 45 (in which the first pressing member 45*b* and the second pressing member 45*a* are combined with each other) for imparting the pressing force, applied to the flange 49 by an unshown constitution, to the entirety of the belt 41 with respect to the longitudinal direction. Further, inside the belt 41, the pressing unit 46 includes the reflecting plate 42, an intermediary member 47, and the slidable member 48. The reflecting plate 42 is provided on the heater 43 side of the pressing unit 46 instead of the pressing roller side of the pressing unit 46. The intermediary member 47 is provided between the pressing member 45 and the slidable member 48, and the slidable member 48 is provided between the intermediary member 47 and the belt 41.

The reflecting plate 42, as a reflecting member, is constituted by a material having a high reflectance, such as silver, for example, and is provided at a position opposing the heater 43. The heater 43 emits light including an infrared wavelength region (0.75 μm<λ<6.00 μm, where λ is a wavelength of the light). Here, light from the heater 43 in the wavelength region of 0.75 μm<λ<6.00 μm is incident light, and a reflectance of this incident light of 80% or more is a high reflectance. Radiation (radiation heat) from the heater 43 is reflected toward an inner surface of the belt 41 by the reflecting plate 42. That is, the surface of the reflecting plate 42 opposing the heater 43 functions as a reflecting portion.

Further, the reflecting plate 42 is a bent at both ends thereof (both ends with respect to the short side direction) in a cross-sectional shape shown in FIG. 4. As shown in FIG. 4, an outside-side surface of the U-shape of the reflecting plate 42 contacts an inside-side surface (inner surface) of the U-shape of the slidable member 48, and is capable of conducting heat between itself and the slidable member 48 (the reflecting plate 42 as the reflecting portion and the heat conducting portion are provided integrally with each other).

The reflectance of the reflecting plate 42 is not 100%, and therefore, during continuous sheet passing, the radiant heat (radiation heat) from the heater 43 is gradually absorbed in the reflecting plate 42, so that the reflecting plate 42 is increased in temperature. In order to utilize this heat for fixing, the side surface of the reflecting plate 42 and the side surface of the slidable member 48 are in contact with each other. That is, heat absorbed by the reflecting plate 42 is conducted to the nip N through the slidable member 48.

Here, a portion where the reflecting plate 42 and the slidable member 48 contact each other functions as the heat conducting portion. Incidentally, in order to conduct the heat of the reflecting plate 42 to the slidable member 48, a constitution in which these are connected by a heat conducting member with a good heat-conductive property may also be employed.

Here, in order to suppress that the heat of the reflecting plate 42 is directly conducted to the pressing member 45, the reflecting plate 42 may preferably be provided at a position where the reflecting plate 42 is not contacted to (is separated from) the pressing member 45. That is, with respect to a size with respect to a width(wise) direction corresponding to the longitudinal direction, when a recording material having a maximum size which is capable of being subjected to a fixing process in the nip is a predetermined recording material, in a region corresponding to a region where the predetermined recording material passes in the longitudinal direction of the pressing roller, the pressing member 45 may preferably be separated from the reflecting plate 42.

The slidable member 48 is formed of a metal material (for example, aluminum, copper, or alloy thereof) having high thermal conductivity, and slides with the inner peripheral surface of the belt 41. Further, the slidable member 48 conducts the heat, to the nip N, from the reflecting plate 42 with heating of the reflecting plate 42 by the heater 43. That is, the slidable member 48 plays a role in assisting heating of the belt 41.

The intermediary member 47 is disposed between the slidable member 48 and the pressing member 45 and has a pressing function similar to the pressing member 45. The intermediary member 47 also has a function of suppressing heat conduction from the slidable member 48 toward the pressing member 45. For that reason, the intermediary member 47 is constituted by a material having low thermal conductivity and a heat-resistant property. The intermediary member 47 may be made of, for example, a material including a heat-resistant resin, ceramic, PEEK or a liquid crystal polymer.

The pressing member 45 is constituted by a first pressing stay (first pressing member, first member) 45*b* and a second stay (second pressing member, second member) 45*a*. Each of the first member 45*b* and the second member 45*a* has a U-shape. The first member 45*b* and the second member 45*a* have a nest shape such that openings of the first member 45*b* and the second member 45*a* face sides opposite from each other and that the second member 45*a* is accommodated in the first member 45*a*.

That is, as shown in FIG. 4, the second member 45*a* is disposed so that, in cross section, the side where the U-shape is open is on the nip side. Further, in the inside thereof, a top surface and two side surfaces are provided, and in the outside thereof, a top surface opposing the reflecting plate 42 and two side surfaces are provided, A surface contacting a bottom of the first member through a heat insulating member 50 is a boundary between the inside and the outside.

On the other hand, the first member 45*b* is disposed so that, in cross section, a side where the U-shape is open is on a side opposite from the nip as shown in FIG. 4. That is, the inside top surface of the second member 45*a* and an inside bottom surface of the first member 45*b* are in an opposing positional relationship. The first member 45*b* includes, in the inside thereof, a bottom surface and two side surfaces which contact the intermediary member 47 and includes, as a boundary between the inside and the outside, a surface contacting the bottom surface of the first member 45*b* through the heat insulating member 50.

The pressing member 45 is formed of a metal material (for example, SUS, carbon steel, or the like) having high strength as a rigid member, and imparts the above-described urging force (pressing force) applied to the flange 49 (FIG. 3) to the entirety of the belt 41 with respect to the longitudinal direction. For this reason, the pressing member 45 is constituted so that bending deformation does not occur when the urging force is applied to the flange 49. The heat insulating member 50 is provided between the second member 45*a* and the first member 45*b*, as shown in FIG. 4. Specifically, the heat insulating member 50 is provided between the outside-side surface of the second member 45*a* and the inside-side surface of the first member 45*b* positioned immediately outside thereof. Further, the heat insulating member 50 is provided between the surface, positioned at the boundary between the inside and the outside of the surface member 45*a*, and the inside-bottom surface of the first member 45*b*.

That is, the heat insulating member 50 is provided in the following manner at the surface forming the inside U-shape of the first member 45*b*. When the surface of the first member 45 on the pressing roller 44 side (rotatable member side) is a bottom (surface) portion and the side surfaces forming the U-shape in cooperation with the bottom portion is a first side surface portion and a second side surface portion, the heat insulating member 50 is provided between the first side surface portion and the second member 45*a* and between the second side surface portion and the second member 45*a*. Further, the heat insulating member 50 is provided between the bottom surface and the second member 45*a*.

Here, with respect to the longitudinal direction of the sheet P capable of being subjected to fixing in the nip N, it is preferable that the heat insulating member 50 is provided in a region corresponding to a region in which a sheet, which is maximum in size with respect to the longitudinal direction, passes during the fixing process. That is, when the recording material having a maximum size capable of being subjected to the fixing process in the nip is a predetermined recording material, the heat insulating member 50 may preferably be provided over a region corresponding to a region in which the predetermined recording material passes in the longitudinal direction of the belt.

Next, in this embodiment, the reason why the heat insulating member 50 is provided will be described. As described above, the heat absorbed by the reflecting plate 42 is conducted to the nip N through the slidable member, but a part of the heat is capable of being conducted to the pressing member 45. Further, the heat of the heated belt 41 can be taken by the slidable member 48 and by the pressing member 45 through the intermediary member 47.

Here, among the members positioned inside the belt 41, particularly, the pressing member 45 has high thermal capacity, and therefore, during continuous sheet passing, heat inflow to the pressing member 45 is conspicuous. Further, when the heat flows into the pressing member 45, electrical power of the heater 43 used for heating the belt 41 is to be used for increasing the temperature of the pressing member 45.

Therefore, in this embodiment, the heat insulating member 50 is provided between the first member 45*b* and the second member 45*a*, so that the heat insulating member 50 is contacted to each of the first member 45*b* and the second member 45*a*.

By this, during continuous sheet passing, the heat inflow to the pressing member 45 when the reflecting plate 42 is increased in temperature can be prevented. Specifically, during continuous sheet passing, even when the heat flows into the first member 45*b*, the heat is not conducted to the second member 45*a*. Further, even when the heat absorbed by the reflecting plate 42 is conducted to the second member 45*a* opposing the reflecting plate 42, by the heat insulating member 50, the heat is not conducted from the second member 45*a* to the first member 45*b*, so that the heat of the reflecting plate 42 is not readily taken by the pressing member 45.

By this, the electrical power consumption during continuous sheet passing can be reduced.

In this embodiment, glass wool of 300 μm in thickness and 0.03 W/(m·K) in thermal conductivity at 200° C. was used as the heat insulating member 50. In the following, an electrical power reduction effect during continuous sheet passing by this embodiment will be described.

Effect in this Embodiment

The electrical power reduction effect during continuous sheet passing by a verification experiment in this embodiment is shown in the following. In this experiment, the fixing device is operated so that electrical power control in which the surface temperature of the belt 41 is maintained at 170° C. is operated, and electrical power required when 60 sheets of A4R recording paper are continuously passed through the fixing device at a speed of 50 ppm was measured.

As the verification experiment, comparison of the above-described necessary electrical power was made using this embodiment in which the heat insulating member 50 was provided between the first member 45*b* and the second member 45*a* and using a comparison example (conventional example) in which the heat insulating member 50 is not provided between the first member 45*b* and the second member 45*a*. A result thereof is shown in a table 1 and FIG. 5. The table 1 shows a result of measurement of the electrical power required when the 60 sheets of the A4R recording paper were continuously passed through the fixing device at the speed of 50 ppm in the conventional example ("COMP. EX.") and in this embodiment ("EMB.").

TABLE 1

| Electric power consumption during continuous sheet passing | | |
|---|---|---|
| | COMV. EX. | EMB. |
| Electric power consumption | 916 W | 870 W |

Figure 5:
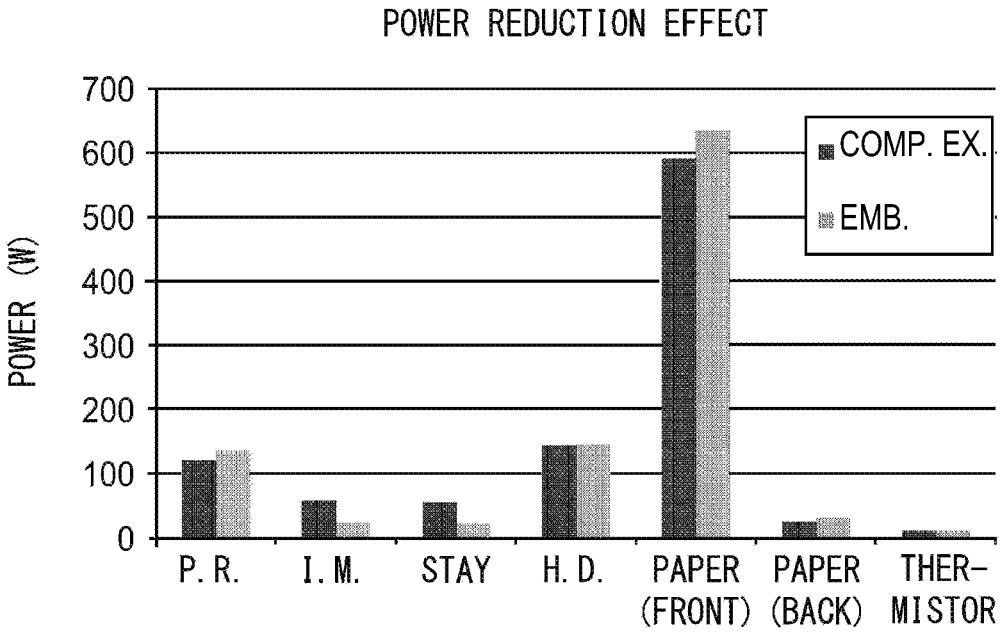
FIG. 5 is an illustration of an effect in a first embodiment.

From a measurement result, in this embodiment, it was able to be confirmed that electrical power consumption during continuous sheet passing can be reduced by about 46 W. Further, FIG. 5 shows a breakdown of electrical power, consumed by the respective fixing members, of the electrical power consumption by simulating a fixing condition in the above-described continuous sheet passing and by performing heat conduction calculation. As shown in FIG. 5, it was able to be verified that, of the electrical power consumed, the electrical power consumed by the pressing member (stay) and the intermediary member is reduced by about 20-30 W by this embodiment and that a reduction amount thereof contributes to reduced electrical power consumption during continuous sheet passing.

Second Embodiment

Next, verification of an effect by changing the thickness and the thermal conductivity of the heat insulating member 50 will be described. In general, a heat insulating effect can be expected with a thicker thickness of the heat insulating member used and with a smaller value of the thermal conductivity. The heat insulating member 50 used in the first embodiment was the glass wool of 300 μm in thickness and 0.03 W/(m·K) in thermal conductivity at 200° C.

Figure 6:
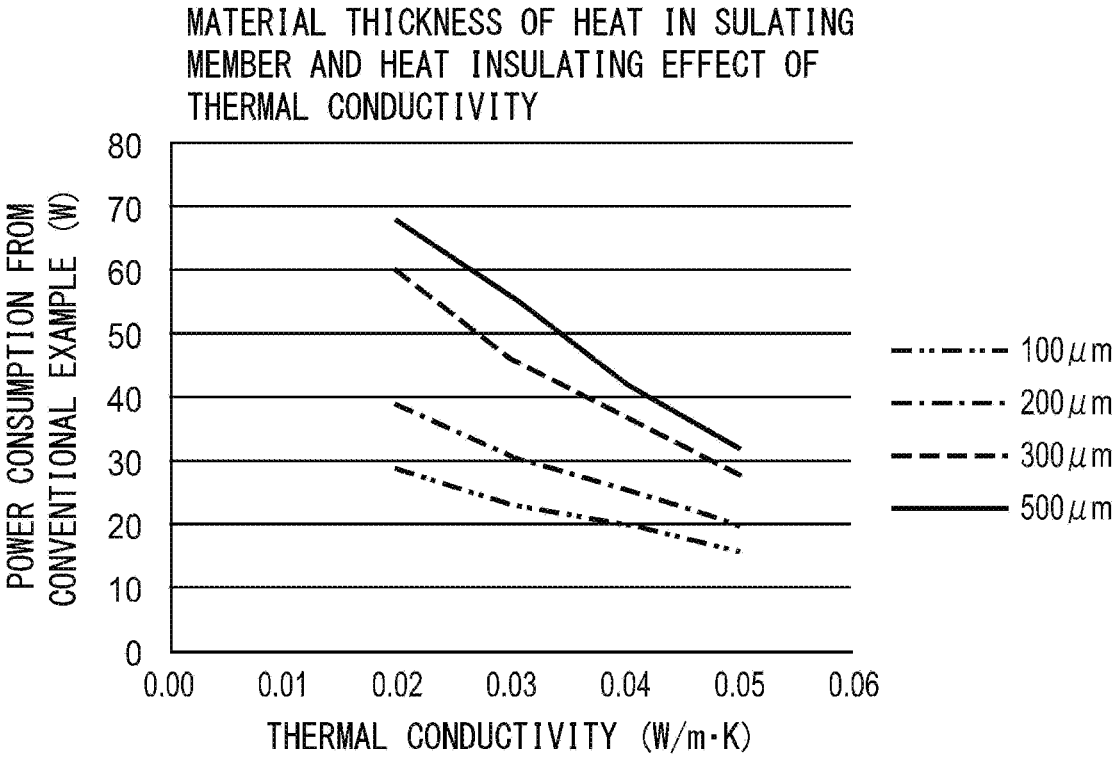
FIG. 6 is an illustration of an effect in a second embodiment.

In this embodiment, a relationship between the thickness and the thermal conductivity of the heat insulating member 50 is checked. For this purpose, materials in which the thickness of the heat insulating member 50 was changed to 100 μm, 200 μm, 300 μm and 500 μm and in which the thermal conductivity is similarly changed from 0.02 to 0.05 W/(m·K) were prepared, and then the above-described continuous sheet passing experiment was conducted, so that the electrical power consumption during continuous sheet passing was checked. A result thereof is shown in table 2 and FIG. 6. In the table 2, an electrical power amount (W) reduced from the electrical power consumption of 916 W in the continuous sheet passing experiment in the comparison example (conventional example) is shown. Further, in FIG. 6, a relationship of the thickness and the thermal conductivity of the heat insulating member 50 with the above-described electrical power reduction amount is shown.

From the above-described result, it is possible to confirm that the electrical power reduction effect in the continuous sheet passing experiment is larger with a thicker thickness of the heat insulating member 50 used and with a smaller thermal conductivity. Conventionally, of the electrical power of 1500 W usable in the image forming apparatus, the electrical power usable in the fixing device is about 1000 W in general. A technique in which the electrical power consumption is reduced even by 1% has been studied actively by considerable design in the above-described electrical power. That is, in an energy saving technique, it can be said that Reduction of 10 W in electrical power of about 1000 W consumed by the fixing device affects performance of a product put in the market.

In this embodiment, a constitution in which an effect of capable of reducing the above-described electrical power consumption of 1% can be expected by changing a combination of the thickness t (μm) of the heat insulating member 50 and the thermal conductivity λ (W/m. K) was verified. As the constitution capable of reducing the electrical power consumption during continuous sheet passing by 1%, it was confirmed that as shown in the table 2 and FIG. 6, the thickness of the heat insulating member is 100 μm or more and the value of the thermal conductivity is 0.05 W/(m·K) or less.

Further, when the Reduction amount of the above-described electrical power consumption is P (W), the thickness of the heat insulating member 50 used is t (μm), and the thermal conductivity is λ (W/m·K), the following relational expression holds.

$$P\ (\mathrm{W})=0.07t-827.5\lambda+45.4$$

At this time, as shown in the table 2, the following formulas may preferably be satisfied:

$$t\geq 100\ (\mu\mathrm{m});\ \text{and}$$

$$0.02\ (\mathrm{W/m\cdot K})\leq\lambda\leq 0.05\ (\mathrm{W/m\cdot K}).$$

By this, the electrical power consumption in the fixing device can be reduced by 10 W or more.

Further, preferably by satisfying the relationship between the thermal conductivity and the thickness in a range shown by a circle in the table 2, reduction in electrical power consumption by 40 W or more can be realized.

Incidentally, as regards the thickness t of the heat insulating member 50, the heat insulating effect thereof becomes larger with a thicker thickness. Therefore, as regards the heat insulating member 50, within a range of t≥100 (μm), the heat insulating member 50 with a thickness such that the heat insulating member 50 and the pressing member 45 are accommodated inside the belt 41 may be used. Specifically, the heat insulating member 50 falling within a range of 1000 (μm)≥t≥100 (μm) may be used.

Further, as shown in the table 2, when the following formulas are satisfied, the electrical power consumption in the fixing device can be reduced by 40 W or more and is more preferable.

$$1000\ (\mu\mathrm{m})\geq t\geq 300\ (\mu\mathrm{m}),$$

$$0.02\ (\mathrm{W/m\cdot K})\leq\lambda\leq 0.03\ (\mathrm{W/m\cdot K})$$

or $$1000\ (\mu\mathrm{m})\geq t\geq 500\ (\mu\mathrm{m}),$$

$$0.02\ (\mathrm{W/m\cdot K})\leq\lambda\leq 0.04\ (\mathrm{W/m\cdot K})$$

TABLE 2

Heat insulating effect verification of material thickness of heat insulating member and thermal conductivity

| | | Thermal conductivity (W/m · K) | | | |
|---|---|---|---|---|---|
| | | 0.02 | 0.03 | 0.04 | 0.05 |
| Thickness | 100 μm | Δ 29 W | Δ 23 W | Δ 20 W | Δ 16 W |
| | 200 μm | Δ 39 W | Δ 31 W | Δ 26 W | Δ 20 W |
| | 300 μm | ○ 60 W | ○ 46 W | Δ 37 W | Δ 28 W |
| | 500 μm | ○ 68 W | ○ 56 W | ○ 42 W | Δ 32 W |

○: Effect of 40 W or more

MODIFIED EMBODIMENTS

As described above, preferred embodiments of the present invention were described, but the present invention is not limited to these embodiments, and can be variously modified and changed within the scope of the gist thereof

Modified Embodiment 1

In the above-described embodiments, the material of the heat insulating member 50 was the glass wool, but the present invention is not limited thereto. For example, a material such as a glass fiber nonwoven fabric may also be used if the material satisfies the condition of the table 2.

Modified Embodiment 2

In the above-described embodiments, as the pressing member opposing the endless belt as the rotatable member, the pressing roller was used, but in place of the pressing roller, the pressing member may also be constituted by an endless belt.

Further, in the above-described embodiments, the case when the rotatable pressing member as the rotatable member and as the pressing member pressed the rotatable fixing member was described. However, the present invention is not limited thereto, but is similarly applicable to also the case when the rotatable member as an opposing member, not the pressing member is pressed by the rotatable fixing member.

Modified Embodiment 3

In the above-described embodiments, as the recording material, the recording paper was described, but the recording material in the present invention is not limited to the paper. In general, the recording material is a sheet-shaped member on which the toner image is formed by the image forming apparatus and includes, for example, regular or irregular members of plain paper, thick paper, thin paper, envelope, post-card, seal, resin sheet, OHP sheet, glossy paper and the like. Incidentally, in the above-described embodiments, for convenience, dealing of the recording material (sheet) P was described using terms, such as sheet feeding, but by this, the recording material in the present invention is not limited to the paper.

Modified Embodiment 4

In the above-described embodiments, the fixing device for fixing the unfixed toner image on the sheet was described as an example, but the present invention is not limited thereto, and is also similarly applicable to an apparatus for heating and pressing a toner image, temporarily fixed on the sheet, in order to improve glossiness of the image (also in this case, the apparatus is called the fixing device).

INDUSTRIAL APPLICABILITY

According to the present invention, there is provided a fixing device capable of reducing electrical power consumption during continuous sheet passing by suppressing heat inflow to the pressing member provided inside the endless belt when the endless belt rotatable around an outer periphery of the heat source is heated by the heat source.

The invention claimed is:

1. A fixing device comprising:

a rotatable endless belt;

a heat source, provided inside said endless belt, for heating said endless belt;

a rotatable member, provided outside said endless belt, for forming a nip in which a toner image on a recording material is fixed together with said endless belt;

a nip forming member made of metal, provided inside said endless belt, for forming the nip in cooperation with said rotatable member, wherein said nip forming member includes (i) a first member having a U-shape in a cross section perpendicular to a longitudinal direction of said rotatable member, the U-shape being open on a side opposite from said rotatable member through the nip and (ii) a second member provided inside said first member;

a contact member provided between the nip and said nip forming member, said contact member contacting an inner peripheral surface of said endless belt;

a reflecting portion for reflecting, toward the inner peripheral surface of said endless belt, radiation heat from said heat source toward said nip forming member;

a heat conducting portion, contacting said contact member, for conducting heat of said reflecting portion to said contact member; and a heat insulating member provided between said first member and said second member, wherein a thickness t (μm) and thermal conductivity λ (W/m·K) of said heat insulating member satisfy the following relationships:

$t \geq 100$ (μm); and $0.02$ (W/m·K) $\leq \lambda \leq 0.05$ (W/m·K).

2. The fixing device according to claim 1, wherein said second member has a U-shape open on the nip side in the cross-sectional shape perpendicular to the longitudinal direction of said rotatable member.

3. The fixing device according to claim 1, wherein a first side surface portion, a bottom portion, and a second side surface portion form the U-shape of said first member, the bottom portion being a surface of said first member on said rotatable member side, and wherein said heat insulating member is provided between said first side surface portion and said second member and between said second side surface portion and said second member.

4. The fixing device according to claim 3, wherein said heat insulating member is provided between said bottom portion and said second member.

5. The fixing device according to claim 1, wherein the thickness t (μm) and the thermal conductivity (W/m·K) satisfy the following relationships:

$t \geq 300$ (μm); and $0.02$ (W/m·K) $\leq \lambda \leq 0.03$ (W/m·K).

6. The fixing device according to claim 1, wherein said heat insulating member is glass wool.

7. The fixing device according to claim 1, wherein said heat insulating member is a nonwoven glass fiber fabric.

8. The fixing device according to claim 1, wherein, when in a size of the recording material with respect to a widthwise direction perpendicular to a feeding direction of the recording material, the recording material having a maximum size capable of being subjected to a fixing process in the nip is a predetermined recording material, with respect to the longitudinal direction of said rotatable member, in a region corresponding to a region where the predetermined recording material passes, and nip forming member is separated from said reflecting portion.

9. The fixing device according to claim 1, wherein the nip is configured to accommodate a maximum size of the recording material with respect to a widthwise direction, the widthwise direction being perpendicular to a feeding direction of the recording material, and wherein, with respect to the longitudinal direction of said rotatable member, said heat insulating member is provided over a region corresponding to the maximum size of the recoding material in a region where the recording material with the maximum size passes.

10. The fixing device according to claim 1, wherein said reflecting portion and said heat conducting portion are integral with each other.

11. The fixing device according to claim 1, comprising an intermediary member between said contact member and said nip forming member.

12. The fixing device according to claim 11, wherein said intermediary member is constituted by a resin material or a ceramic material.

13. The fixing device according to claim 1, wherein said heat source is a halogen heater.

14. The fixing device according to claim 1, wherein the thickness t (μm) of said heat insulating member is 1000 μm or less.

* * * * *